US009362641B2

(12) United States Patent
Bachmutsky

(10) Patent No.: US 9,362,641 B2
(45) Date of Patent: Jun. 7, 2016

(54) ORTHOGONAL BACKPLANE DESIGN WITH REDUCED CHASSIS DEPTH

(71) Applicant: Telefonaktiebolaget L M Ericsson (publ), Stockholm (SE)

(72) Inventor: Alexander Bachmutsky, Sunnyvale, CA (US)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 186 days.

(21) Appl. No.: 14/321,683

(22) Filed: Jul. 1, 2014

(65) Prior Publication Data

US 2016/0006150 A1 Jan. 7, 2016

(51) Int. Cl.
*H01R 12/72* (2011.01)
*H01R 12/73* (2011.01)

(52) U.S. Cl.
CPC ..... *H01R 12/722* (2013.01); *H01R 12/737* (2013.01)

(58) Field of Classification Search
CPC .... H01R 12/737; H01R 12/722; H01R 12/52; H01R 12/714; H01R 12/718; H01R 12/721; H01R 12/728
USPC ..... 439/65, 78, 60–62, 924.1; 361/785, 361/724, 727, 728
See application file for complete search history.

(56) References Cited

U.S. PATENT DOCUMENTS 5,316,489 A * 5/1994 Kachlic ..... H01R 12/721 439/569
6,490,169 B1 * 12/2002 Watanabe ..... H01R 12/79 174/250
6,508,675 B1 * 1/2003 Korsunsky ..... H01R 12/721 439/60
6,918,775 B2 * 7/2005 Korsunsky ..... H01R 13/193 439/65
7,864,544 B2 * 1/2011 Smith ..... H05K 3/366 361/770
8,120,912 B2 2/2012 Aybay et al.
2009/0149041 A1 6/2009 Morlion et al.
2010/0014248 A1 1/2010 Boyden et al.
2014/0220795 A1 * 8/2014 Bai ..... H01R 12/737 439/61

OTHER PUBLICATIONS

"Impact™ Backplane Connector and Cable Assembly System," http://www.molex.com/molex/products/family?key=impact backplane connector system&channe1=Products &chanName=family&pageTitle=Introduction; 5pgs. (last accessed on Jul. 2, 2014).

* cited by examiner

*Primary Examiner* — Edwin A. Leon
(74) *Attorney, Agent, or Firm* — Nicholson De Vos Webster & Elliott, LLP

(57) ABSTRACT

According to some embodiments of the invention a device includes a first circuit board having a hollow slot, wherein a longitudinal length of the hollow slot is greater than a transverse length of the hollow slot, wherein a longitudinal axis of the hollow slot is parallel to a first edge of the first circuit board, wherein the hollow slot causes a gap at a second edge of the first circuit board, and wherein the hollow slot is adapted to accept a second circuit board that is oriented orthogonally to the first circuit board. The device may further include a first data transferring connector coupled to the first circuit board at a longitudinal terminus of the hollow slot, wherein the first data transferring connector is adapted to connect to a second data transferring connector that is coupled to the second circuit board.

23 Claims, 9 Drawing Sheets

ORTHOGONAL BACKPLANE DESIGN WITH REDUCED CHASSIS DEPTH

FIELD

Embodiments of the invention relate to the field of networking; and more specifically, to orthogonal backplane design with reduced chassis depth.

BACKGROUND

Orthogonal connectors may be used to connect orthogonally oriented circuit boards together at multiple connector locations. Orthogonal connectors may also be known as orthogonal backplane connectors. FIG. 1 illustrates the interior of a typical chassis including orthogonal connectors (e.g., orthogonal connectors 108*a-e*). These connectors 108 allow each one of the one or more horizontal circuit boards, such as line cards 102*a* and 102*b*, to be connected with every other one of the vertical circuit boards, such as control cards 106*a-e*. For example, control card 106*a* is coupled with orthogonal connector 110*a*, line card 102*a* is coupled to orthogonal connector 108*a*, and orthogonal connectors 108*a* and 110*a* are connected to each other. This connection couples line card 102*a* with control card 106*a*. Using orthogonal connectors, all circuit boards of one physical orientation may be able to connect to all circuit boards of the orthogonal orientation. In some cases, the horizontal and vertical circuit boards are separated via a midplane, such as midplane 104. In such a case, the midplane may include additional connectors that are used to join the orthogonal connectors of the two circuit boards together. Typically the midplane does not include additional circuitry other than the additional intermediate connectors. Orthogonal connectors may be used in networking equipment such as hubs, switches, routers, cellular equipment, servers, storage systems, etc.

SUMMARY

According to some embodiments, a device comprises a first circuit board having a hollow slot, wherein a longitudinal length of the hollow slot is greater than a transverse length of the hollow slot, wherein a longitudinal axis of the hollow slot is parallel to a first edge of the first circuit board, wherein the hollow slot causes a gap at a second edge of the first circuit board, and wherein the hollow slot is adapted to accept a second circuit board that is oriented orthogonally to the first circuit board. The device further comprises a first data transferring connector coupled to the first circuit board at a longitudinal terminus of the hollow slot, wherein the first data transferring connector is adapted to connect to a second data transferring connector that is coupled to the second circuit board.

According to some embodiments, the first data transferring connector is at least one of an electrical connector and an optical connector.

According to some embodiments, the first data transferring connector is an orthogonal backplane connector.

According to some embodiments, the device further comprises a third data transferring connector that is adjacent to the hollow slot and is coupled to the first circuit board and that has a connection interface facing the second edge of the first circuit board, wherein the third data transferring connector is adapted to connect to a fourth data transferring connector that is coupled to the second circuit board.

According to some embodiments, the third data transferring connector is an orthogonal backplane connector. According to some embodiments, the third data transferring connector is a socket designed to accept an edge connector.

According to some embodiments, the device further comprises a third data transferring connector coupled to the circuit board with an interface facing the longitudinal edge of the hollow slot.

Thus, embodiments of the invention include a device for orthogonal backplane design with reduced chassis depth.

BRIEF DESCRIPTION OF THE DRAWINGS

The invention may best be understood by referring to the following description and accompanying drawings that are used to illustrate embodiments of the invention. In the drawings.

DESCRIPTION OF EMBODIMENTS

Figure 1:
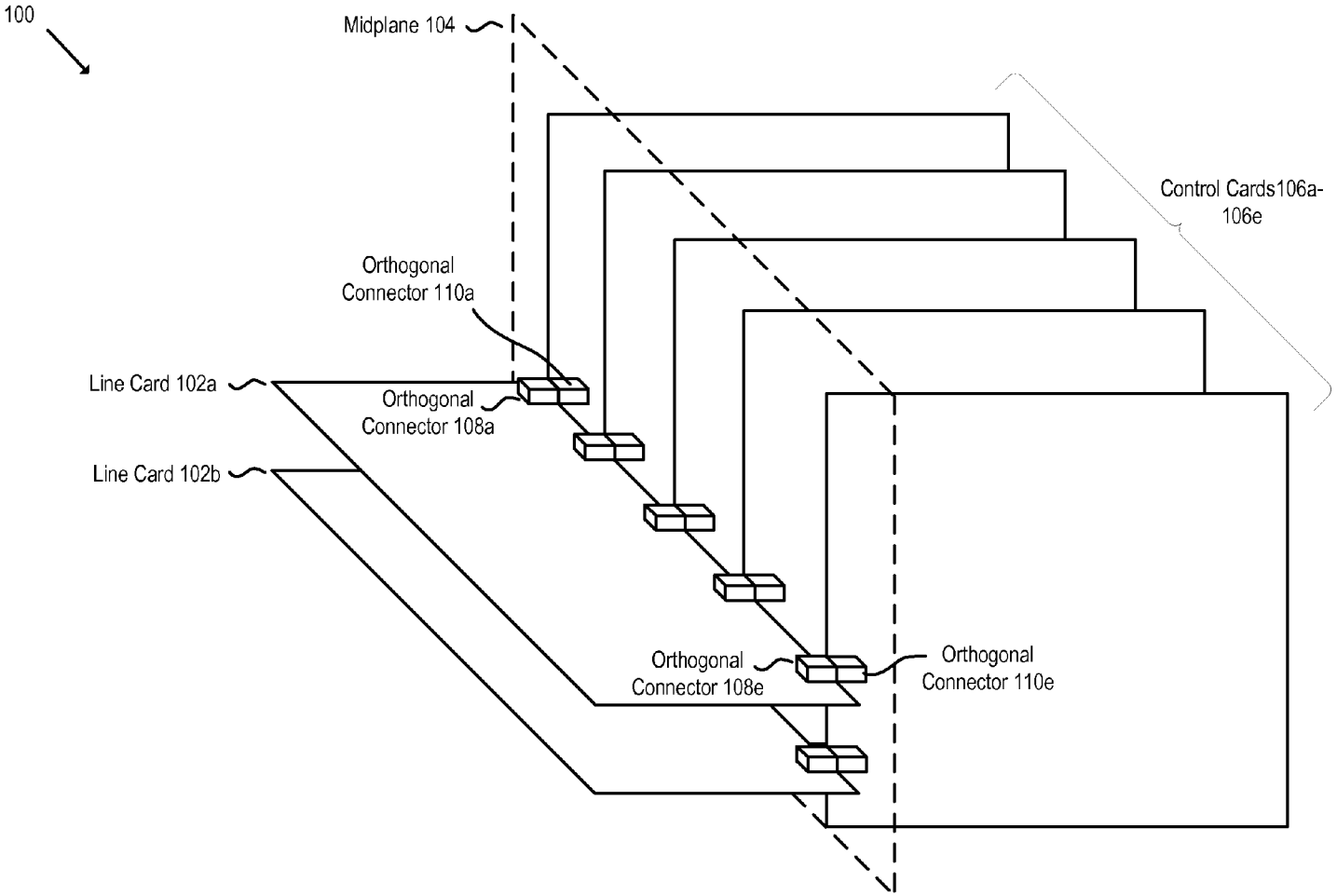
FIG. 1 (Prior Art)
FIG. 1 illustrates the interior of a typical chassis including orthogonal connectors according to the prior art.

In the following description, numerous specific details are set forth. However, it is understood that embodiments of the invention may be practiced without these specific details. In other instances, well-known circuits, structures and techniques have not been shown in detail in order not to obscure the understanding of this description.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In the following description and claims, the terms "coupled" and "connected," along with their derivatives, may be used. It should be understood that these terms are not intended as synonyms for each other. "Coupled" is used to indicate that two or more elements, which may or may not be in direct physical or electrical contact with each other, co-operate or interact with each other. "Connected" is used to indicate the establishment of communication between two or more elements that are coupled with each other.

An electronic device (e.g., an end station, a network device) stores and transmits (internally and/or with other electronic devices over a network) code (composed of software instructions) and data using machine-readable media, such as non-transitory machine-readable media (e.g., machine-readable storage media such as magnetic disks; optical disks; read only memory; flash memory devices; phase change memory) and transitory machine-readable transmission media (e.g., electrical, optical, acoustical or other form of propagated signals—such as carrier waves, infrared signals). In addition, such electronic devices typically include a set of one or more processors coupled to one or more other components, such as one or more non-transitory machine-readable media (to store code and/or data), user input/output devices (e.g., a keyboard, a touchscreen, and/or a display), and network connections (to transmit code and/or data using propagating signals). The coupling of the set of processors and other components is typically through one or more busses and bridges (also termed as bus controllers). Thus, a non-transitory machine-readable medium of a given electronic device typically stores instructions for execution on one or more processors of that electronic device. One or more parts of an embodiment of the invention may be implemented using different combinations of software, firmware, and/or hardware.

As used herein, a network device (e.g., a router, switch, bridge) is a piece of networking equipment, including hardware and software, which communicatively interconnects other equipment on the network (e.g., other network devices, end stations). Some network devices are "multiple services network devices" that provide support for multiple networking functions (e.g., routing, bridging, switching, Layer 2 aggregation, session border control, Quality of Service, and/or subscriber management), and/or provide support for multiple application services (e.g., data, voice, and video).

Network devices are commonly separated into a control plane and a data plane (sometimes referred to as a forwarding plane or a media plane). In the case that the network device is a router (or is implementing routing functionality), the control plane typically determines how data (e.g., packets) is to be routed (e.g., the next hop for the data and the outgoing port for that data), and the data plane is in charge of forwarding that data. For example, the control plane typically includes one or more routing protocols (e.g., Border Gateway Protocol (BGP), Interior Gateway Protocol(s) (IGP) (e.g., Open Shortest Path First (OSPF), Routing Information Protocol (RIP), Intermediate System to Intermediate System (IS-IS)), Label Distribution Protocol (LDP), Resource Reservation Protocol (RSVP)) that communicate with other network devices to exchange routes and select those routes based on one or more routing metrics.

Typically, a network device includes a set of one or more line cards, a set of one or more control cards, and optionally a set of one or more service cards (sometimes referred to as resource cards). These cards are coupled together through one or more mechanisms (e.g., a first full mesh coupling the line cards and a second full mesh coupling all of the cards). The set of line cards make up the data plane, while the set of control cards provide the control plane and exchange packets with external network device through the line cards or internal networking ports. The set of service cards can provide specialized processing (e.g., Layer 4 to Layer 7 services (e.g., firewall, IPsec, IDS, P2P), VoIP Session Border Controller, Mobile Wireless Gateways (GGSN, Evolved Packet System (EPS) Gateway)). By way of example, a service card may be used to terminate IPsec tunnels and execute the attendant authentication and encryption algorithms.

Figure 2:
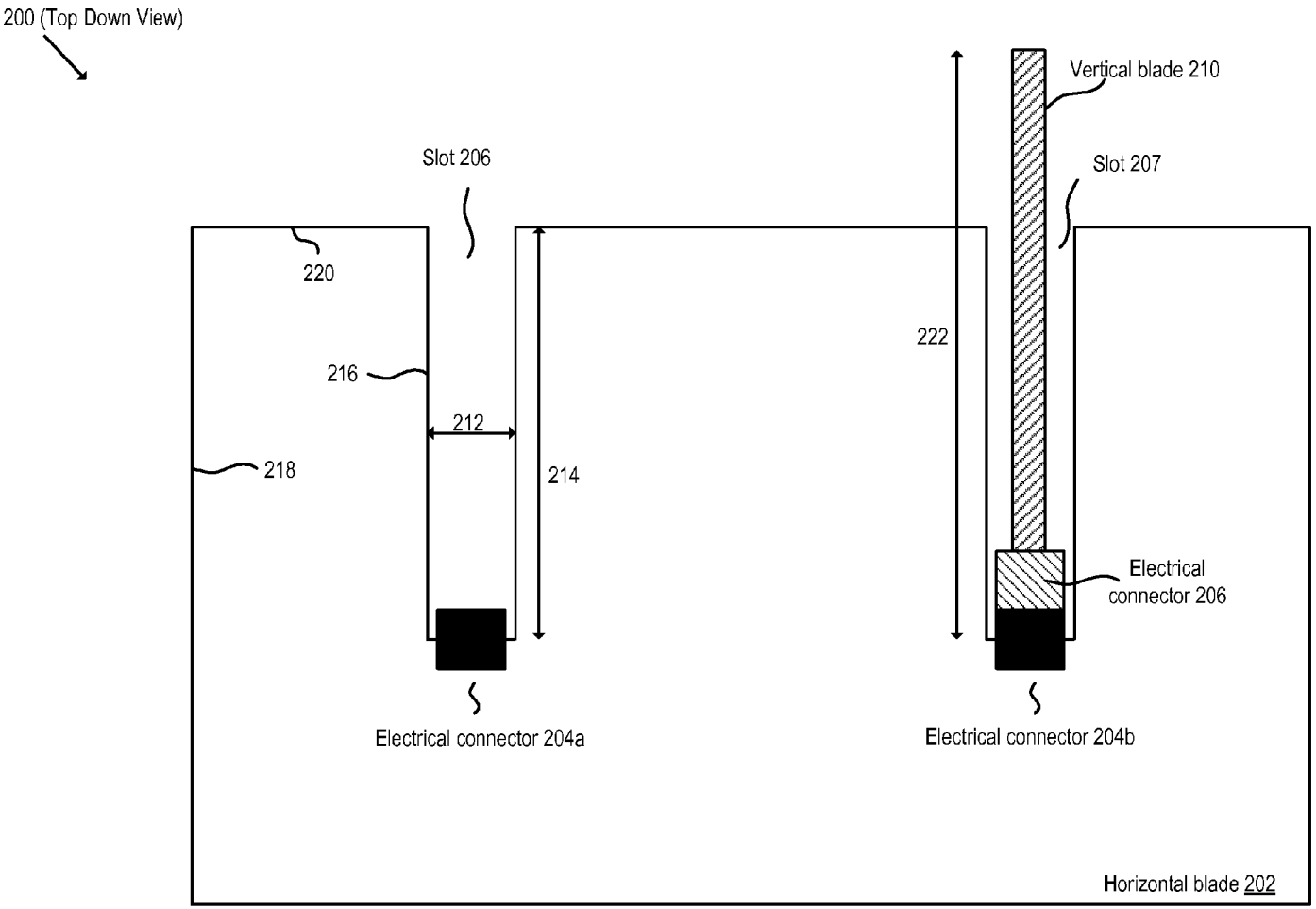
FIG. 2 illustrates a top down perspective of a system 200 including an electrical connector according to some embodiments of the invention.

FIG. 2 illustrates a top down perspective of a system 200 including an electrical connector according to some embodiments of the invention. System 200 includes a horizontal blade 202. Horizontal blade 202 may be a 1) circuit board, 2) substrate, 3) a package, 4) a die (e.g., a microelectronic device constructed from a bulk monocrystalline semiconductor substrate with semiconductor devices on top that are electrically coupled by metal interconnect layers, with a passivation layer disposed over the metal interconnect layers, and contacts exposed in openings in the passivation layer and electrically coupled to the metal interconnect layers), 5) a planar surface having circuits, connectors, wires, and/or redistribution lines, or 6) horizontal blade 202 may have other electronics placed on top. In some embodiments, the components coupled to horizontal blade 202 enable it to perform the functions of an electronic device. In some embodiments, horizontal blade 202 represents a switch, control card, or management plane of a network device. Although horizontal blade 202 is labeled as being horizontal in orientation, this is only for ease of explanation in relation to the other components of the system and horizontal blade 202 can, in some embodiments, be in any orientation. In some embodiments, horizontal blade 202 is housed in a chassis (not shown).

Horizontal blade 202 includes a slot 206. In some embodiments, horizontal blade includes more than one slot. For example, the depicted horizontal blade 202 also includes a slot 207. Slot 206 is hollow, and does not include any circuit board, substrate, or other material that horizontal blade 202 is comprised of. Slot 206 has a longitudinal length 214 that is greater than the transverse length 212. In some embodiments, the longitudinal edge 216 of slot 206 is parallel to an edge 218 of horizontal blade 202. In some embodiments, the slot 206 is a trapezoidal shape, with the wider base along edge 220. In such an embodiment, the longitudinal axis of the trapezoidal slot 206 is parallel with edge 218. The slot 206 causes a gap in a second edge 220 of the horizontal blade 202 such that a cutout is created in the horizontal blade 202 as depicted.

An electrical connector **204*a* is coupled to the horizontal blade 202 at the longitudinal terminus of the slot 206. This electrical connector 204*a* may protrude into slot 206 and can connect with another electrical connector that is mated to electrical connector 204*a*. In some embodiments, electrical connector 204*a* lies flush with the slot 206 or is placed to leave a gap between electrical connector 204*a* and the slot 206. In some embodiments, electrical connector 204*a* is an orthogonal backplane connector. In some embodiments, electrical connector 204*a* is a keyed connector, crimp connector, insulation-displacement connector, plug/socket connector, blade connector, edge connector, or any other connector capable of carrying data in an electronic form. An exemplary structure for the electrical connector 204*a* is described in reference to FIG. 6*a***.

In some embodiments, a vertical blade is placed in a slot. For example, vertical blade 210 is placed in slot 207. Vertical blade 210 is orthogonal to horizontal blade 202. Following the orientation of the top down view of FIG. 2, vertical blade 210 is normal or perpendicular to the surface of a page that includes FIG. 2. Vertical blade 210 may be a circuit board, substrate, or any other planar object similar horizontal blade 202. In some embodiments, vertical blade 210 is a line card or management plane of a network device. In some embodiments, the dimensions of slot 207 are such that the entire longitudinal length 222 of vertical blade 210 fits within or stays within the boundaries of slot 207 such that vertical blade 210 does not protrude beyond edge 220 of horizontal blade 202.

Although a particular transverse dimension 212 is illustrated for the slot 206, in some embodiments the slot includes a transverse dimension 212 that is only wide enough to allow the successful insertion of a vertical blade.

Vertical blade 210 includes an electrical connector 206 that is mated or connected to electrical connector 204*b* on horizontal blade 202. This allows vertical blade 210 to be coupled with horizontal blade 202. Although electrical connector 206 is depicted as being centrally aligned with vertical blade 210, in other embodiments electrical connector 206 is not centrally aligned with vertical blade 210 and may be coupled with vertical blade at an offset position.

Unlike prior art systems where the vertical blade 210 would be connected to horizontal blade 202 at the edge of the horizontal blade (e.g., edge 220), FIG. 2 illustrates a system 200 where a substantial amount of volume is saved by having a horizontal blade with a slot such that a vertical blade may be placed within such a slot. A chassis including such a horizontal blade 202 could be of shallower depth and significant volume would be saved as a result. Systems administrators often remove various blades from a chassis. A chassis with a more compact blade assembly, such as a chassis including a horizontal blade such as 202, simplifies installation and removal of blades as the chassis is shallower allowing easier access to the blades. The shallower depth of a chassis including a horizontal blade 202 also improves cooling efficiency. A cooling system does not need to send an airflow over the length of two blades or over a midplane, and instead can send a reduced flow over a shallower arrangement of blades.

Note that although the above description and related figure reference an electrical connector, in some embodiments, instead of an electrical connector, the system 200 includes an optical connector. In other embodiments, instead of an electrical connector, the system 200 includes any type of connector capable of transferring data (e.g., a wireless connector).

Figure 3:
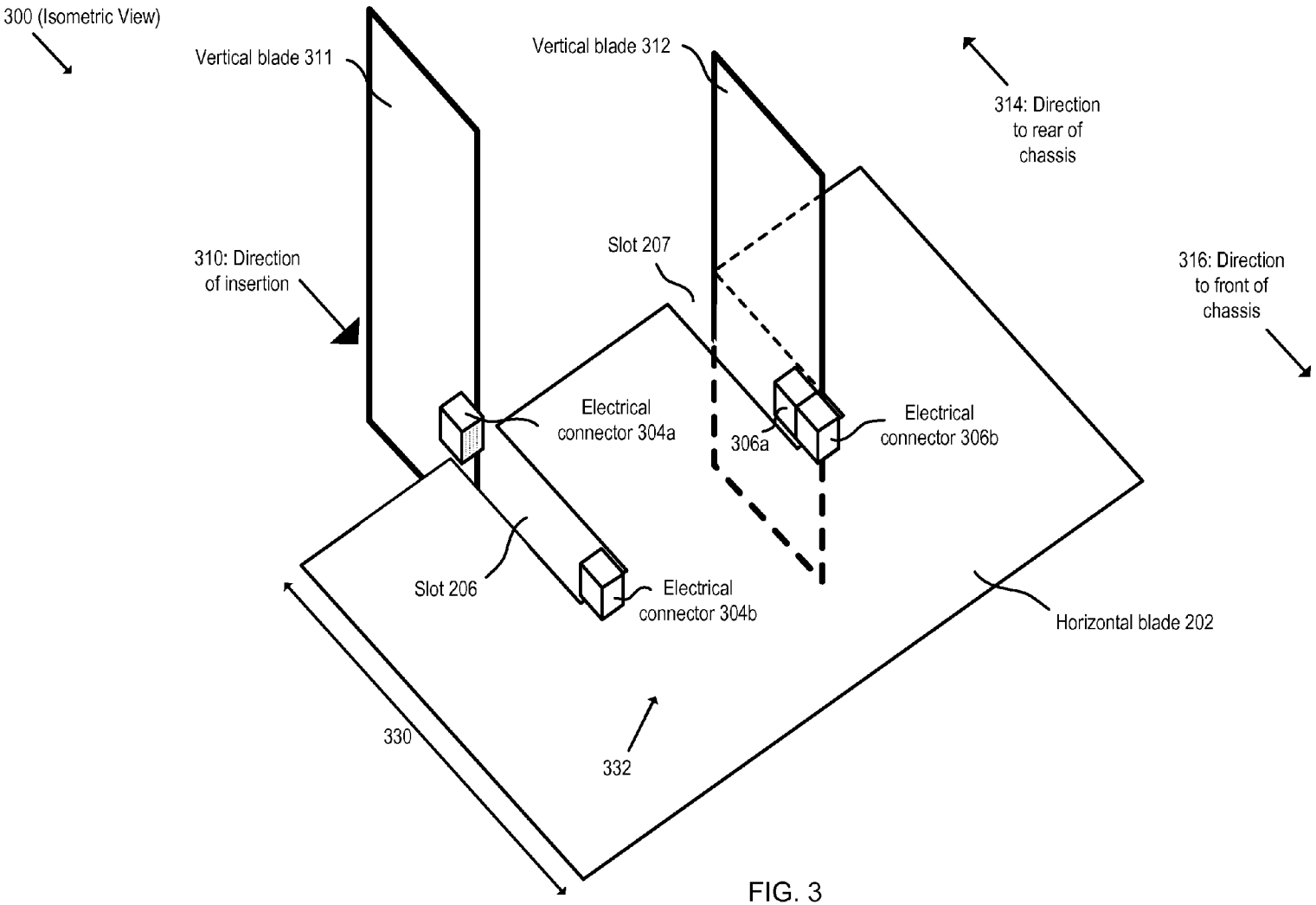
FIG. 3 illustrates an isometric view of a system 300 including an electrical connector according to some embodiments of the invention.

FIG. 3 illustrates an isometric view of a system 300 including an electrical connector according to some embodiments of the invention. In some embodiments, system 300 is housed in a chassis. The vertical blades 311 and 312 are closer to the rear 314 of this chassis, and the horizontal blade 202 is closer to the front 316 of the chassis. In some embodiments, the orientation is reversed (e.g., rear and front are reversed) or rotated by 90 degrees in relation to the chassis (e.g., vertical blades become horizontal and horizontal blades become vertical).

Vertical blade 311 includes an electrical connector 304*a* that as illustrated is not connected with electrical connector 304*b* on horizontal blade 202. Vertical blade 311 is inserted into slot 206 according to the direction of insertion 310. In some embodiments, slot 206 includes a stopping mechanism (not shown) such that vertical blade 311 is not inserted beyond a point that might cause damage to electrical connectors 304*a* and 304*b*. In some embodiments, horizontal blade 202 includes stabilization mechanisms (e.g., a mechanical fastener, a clamp, a physical guide) to stabilize and/or lock-in-place vertical blade 311 once vertical blade 311 is connected to horizontal blade 202 via electrical connectors 304*a* and 304*b*.

Vertical blade 312 is illustrated as being inserted into horizontal blade 202 such that electrical connector 306*a* is connected to electrical connector 306*b*. As vertical blade 312 is connected to horizontal blade 202 via their respective electrical connectors (i.e., connectors 306*a* and 306*b*), those elements or components (e.g., a microprocessor) coupled to vertical blade 312 may now communicate with elements or components coupled to vertical blade 202. In some embodiments, this communication is similar to the communication between orthogonal blades in a system such as system 100.

Note that while electrical connectors 306*a* and 306*b* are placed on the top and left side of the vertical blade from the isometric perspective of FIG. 3, in some embodiments of the invention electrical connectors 306*a* and 306*b* are placed at another location relative to the vertical blade (e.g., top right, bottom left, bottom right, and at the edge 220).

In some cases the slot (e.g., slot 206) may occupy a significant amount of one dimension of the horizontal blade 202 (e.g., the longitudinal dimension 330), such that the entire length of the vertical blade being inserted into the slot may be within the dimensions of the horizontal blade 202. In some embodiments, the circuits or components on horizontal blade 202 may be comprised of many replicated groups of elements (e.g., control card processing units). Each group of elements may represent a self-contained process (e.g. the control plane processing for a group of network elements sharing a transport protocol). Thus, the amount of communications between each group of elements may be limited to those communications that are needed between self-contained processes, instead of communications between different components of a single process In these embodiments, each replicated group of elements may be placed between slots (i.e., between the longitudinal edges of the slots), with the circuitry needed for communications between each group of elements placed in the remaining area of the horizontal blade between the longitudinal terminus of the slot and the edge of the horizontal blade (e.g., area 332). This reduces any additional latency that may be introduced by the slots when a circuit on the horizontal blade 202 (e.g., a conductive track, redistribution line, etc.) may need to take a longer route on horizontal blade 202 in order to navigate around the slots.

In some embodiments the horizontal blade 202 may need to be extended in either a longitudinal or transverse dimension or in both dimensions in order to accommodate the vertical blades. However, compared to the prior art solution of having the vertical blades extend off horizontal blades that do not have slots, extending the dimensions of the horizontal blade still significantly reduces the total volume used by the orthogonal blade assembly.

Although only two slots (i.e., slots 206 and 207) are depicted in FIG. 3, in some embodiments a horizontal blade 202 includes more than two slots, such that each slot including an electrical connector is capable of accepting a vertical blade. Furthermore, although only the horizontal blade 202 is depicted as having slots, in some embodiments both the vertical blade(s) and the horizontal blade(s) include slots and are coupled together, such that those blades that need to devote more surface area to circuitry or other elements may not include slots, and those blades which do not have dense circuitry or a high density of elements may include the slots instead.

Figure 4:
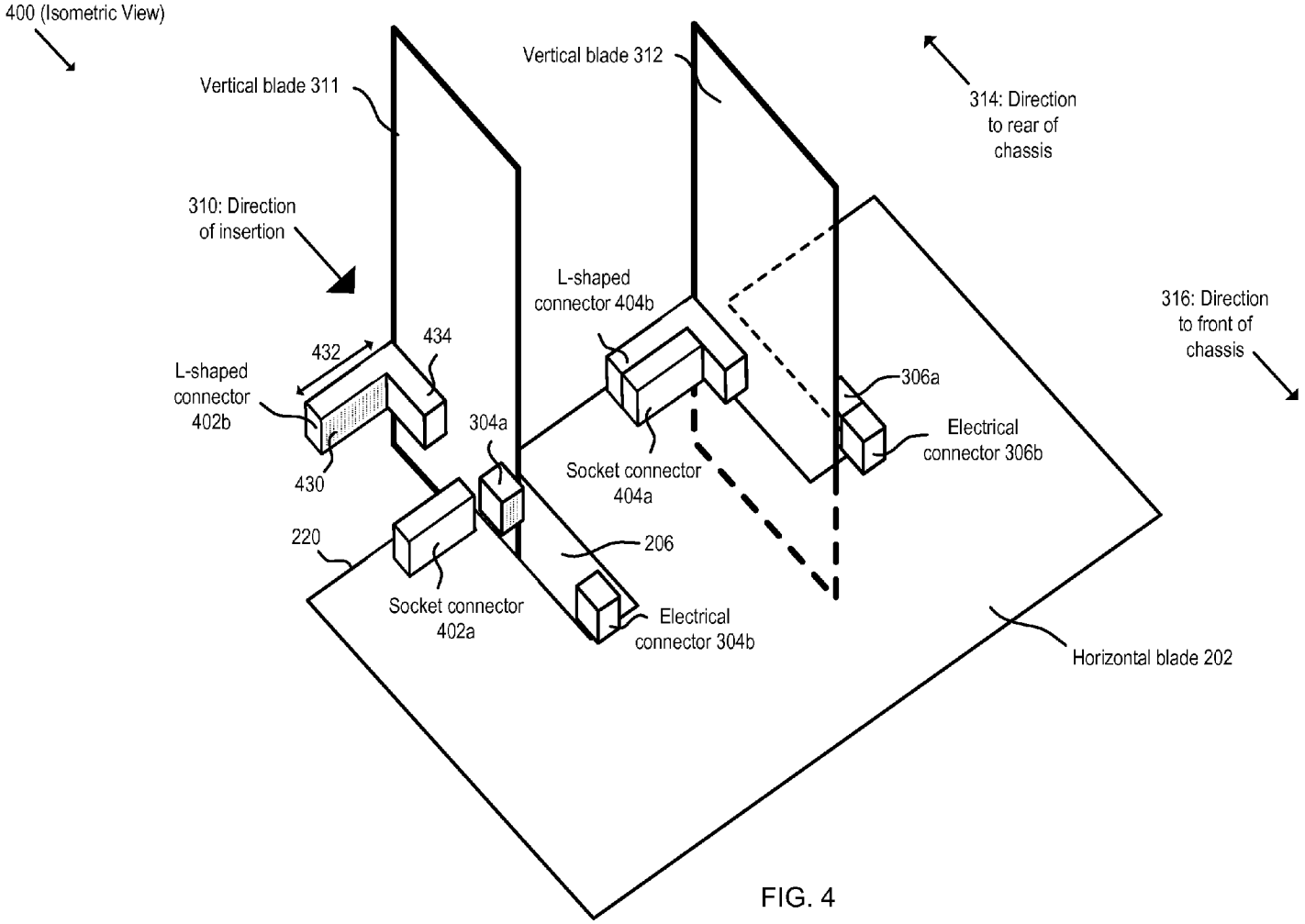
FIG. 4 illustrates an isometric view of a system 400 including an alternative electrical connector according to some embodiments of the invention.

FIG. 4 illustrates an isometric view of a system 400 including an alternative electrical connector according to some embodiments of the invention. While FIGS. 2 and 3 illustrate an electrical connector (e.g., connector 304) coupled at the longitudinal terminus of the slot to the horizontal blade, FIG. 4 illustrates an additional type of L-shaped connector (e.g., 402*b*) that may be connected to a socket connector (e.g., 402*a*) at the forward edge (e.g., edge 220) of the horizontal blade.

In FIG. 4, when vertical blade 311 is inserted into the slot in horizontal blade 202, the interface 430 on L-shaped connector 402*b* makes contact with the mated socket connector 402*a*. In some embodiments, the interface 430 is a set of pins. In some embodiments, the interface 430 is an edge connector. Embodiments of physical implementations of the L-shaped connector and its mated socket connector are described in detail with reference to FIGS. 6*b* and 7*b*. Through solder joints, conductive tracks, or other connection methods, the interface 430 exposed in L-shaped connector 402*b* is coupled with various electronic and circuitry components on vertical blade 311.

As edge 220 of horizontal blade 202 can be longer than the transverse edge of the slot 206 where electrical connector 304*b* is coupled to, the width 432 of the interface 430 may be longer than the width of the interface at electrical connector 304*b*. The data throughput rate of the communications between a vertical blade connected to a horizontal blade is limited by the number of pins or contact elements in the interface of an electrical connector that connects the two blades. For example, the throughput in electrical connector 304*b* may be limited by the clock speed at which the interface of electrical connector 204*b* operates, multiplied by the number of data-carrying differential pairs (i.e. contact point pairs) that are available in the interface of electrical connector 304*b*. In some embodiments, the width of interface 430 is not limited to a specific width and can be increased to a width so that the number of contact points available on the lengthened interface 430 is sufficient to provide a specified or required data throughput rate between the vertical blade 311 and horizontal blade 202. Consequently, through the wider interface 430 at L-shaped connector 402*b*, vertical blade 311 and horizontal blade 202 may be able to send more electrical signals or data per unit time to each other compared to the interface at electrical connector 304*b*. Hence, the system 400 depicts an interface between a vertical and horizontal blade that is not limited to a single connector that has a limited connector size and differential pair density, which would be the case in a prior art orthogonal connection scenario (like that depicted in FIG. 1). Instead, L-shaped connector 402*b* and its corresponding socket connector 402*a* may be coupled with the vertical blade and horizontal blade, respectively, so that the connection density and number of interface points is increased over the prior art connector scenario.

In some embodiments, vertical blade 311 includes more than one L-shaped connector 402*b*. Vertical blade 311 and horizontal blade 202 interface along four quadrants. These may be described in the isometric view of FIG. 4 as top left, top right, bottom left, and bottom right. The depicted L-shaped connector 402*b* is located at top left. Additional L-shaped connectors may be placed at a bottom left quadrant with the L-shaped connector having the same orientation as L-shaped connector 402*b*, or be placed on the top right or bottom right quadrants, with the L-shaped connector at those locations having an orientation that mirrors that of L-shaped connector 402*b*.

Although the protruding element 434 is depicted in FIG. 4 with a particular dimension relative to the interface element 430, in some embodiments the protruding element 434 does not need to be of these dimensions. A purpose of protruding element 434 is to allocate an area on vertical blade 311 to facilitate the connection of all the interface points on interface 430 with their respective solder points or other connection points (with other circuitry) on vertical blade 311. These connections may be achieved using a variety of methods (e.g., solder joints, contact pads, wire-bonding). The choice of connection method may then determine the size and dimensions of the protruding element 434. In some embodiments, the L-shaped connector 402*b* does not include a protruding element 434, as all the connections between the interface 430 and the vertical blade 311 are included within the non-protruding section of the L-shaped connector 402*b* at the area where the L-shaped connector 402*b* contacts the vertical blade 311.

As illustrated, vertical blade 312 is inserted into horizontal blade 202, and its connectors (L-shaped connector 404*b*; electrical connector 306*a*) are connected or mated to the corresponding connectors on horizontal blade 202 (socket connector 404*a*; electrical connector 306*b*). The socket connector 404*a* fits within the "L" shape of L-shaped connector 404*b* as depicted. In some embodiments, L-shaped connector 404*b* contacts the surface of horizontal blade 202 when it is connected to socket 404*a*. In these embodiments, the areas of horizontal blade 202 where the L-shaped connector 404*b* contact are free of any protrusions that would affect the ability of the L-shaped connector 404*b* to sit flush with the horizontal blade 202. In some embodiments, the L-shaped connector 404*b* is flush with the edge 220 of horizontal blade 202, such that no part of vertical blade 312 or the L-shaped connector 404*b* protrudes beyond the edge 220 of horizontal blade 202. This may allow for a compact chassis design.

In some embodiments, and as depicted, electrical connector 306*a* is not on the same surface of vertical blade 312 as L-shaped connector 404*b*. Instead, the connectors may be on any of the surfaces of vertical blade 312, and may be situated above, below, or on the edge (e.g., edge 220) in the middle of horizontal blade 202 in any combination when the vertical blade is inserted into a slot in horizontal blade 202. For example, for vertical blade 311, the electrical connector 304*a* is located on the same surface of vertical blade 311 as L-shaped connector 402*b*. In some embodiments, depending on the placement of the connector elements on a horizontal blade or on a vertical blade, the connectors may be placed in an orientation that facilitates easy insertion of the vertical blade. For example, electrical connector 306*a* may be placed on the obverse surface of vertical blade 312 in relation to L-shaped connector 404*b*, instead of on the same side as L-shaped connector 404*b*, so that the insertion of the vertical blade 312 is not accidentally obstructed if socket connector 404*a* were to make contact with electrical connector 306*a*.

In some embodiments, the slots (e.g., slot 206) on the horizontal blade 202 may be placed such that vertical boards are inserted into the slots in opposite directions. For example, one vertical blade may be inserted into a slot from the rear of the chassis, while one vertical blade may be inserted into a slot in the horizontal blade 202 from the direction of the front of the chassis. This may allow for the interface 430 on L-shaped connector 402*b* to be made even wider as it is not obstructed by another adjacent slot.

Although FIG. 4 is described with reference to a socket connector, the invention is not limited to having the socket connector be a "female" socket, and in some embodiments, the socket connector includes the "male" connector and the mated L-shaped connector includes the "female" connector.

Figure 5:
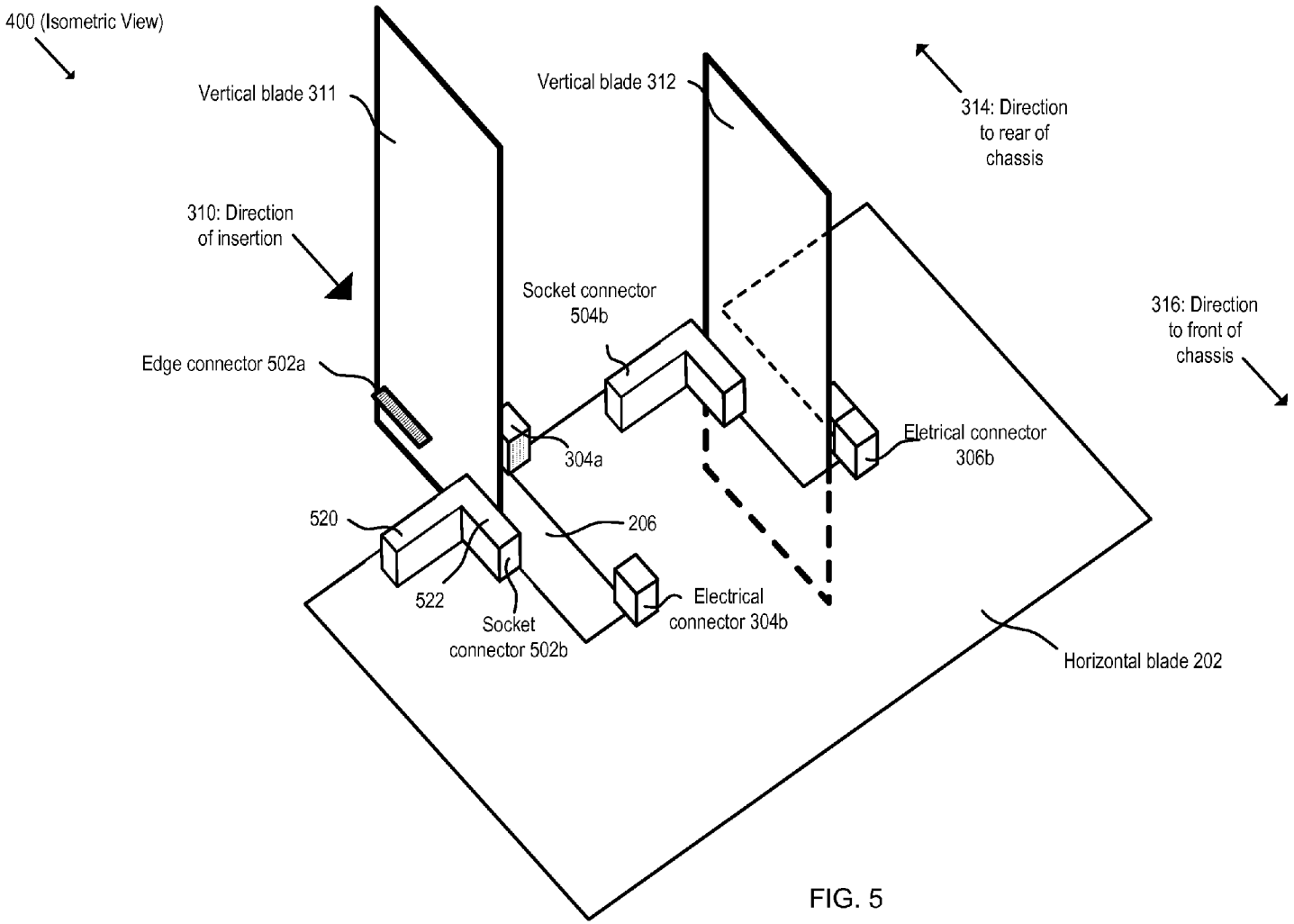
FIG. 5 illustrates an isometric view of a system 500 including an alternative electrical connector according to some embodiments of the invention.

FIG. 5 illustrates an isometric view of a system 500 including an alternative electrical connector according to some embodiments of the invention. While FIG. 4 illustrated an L-shaped connector (e.g., 402*b*) coupled to a socket connector (e.g., 402*a*), FIG. 5 illustrates an edge connector (e.g., 502*a*) on a vertical blade 311 to be inserted into a slot in a socket connector (e.g., 502*b*) on the horizontal blade 202.

In some embodiments of the invention, instead of having an interface 430 on an L-shaped connector 402*b* coupled to the vertical blade 311, vertical blade 311 instead has an edge connector 502*a* that slides into a socket or slot, which is located at interface section 522 of socket connector 502*b*. This edge connector 502*a* has its longitudinal edge parallel and attached to the surface of the vertical blade 311. The traces on the edge connector 502*a* are coupled with electrical components and circuitry on vertical blade 311. An embodiment of the physical implementation of the edge connector 502*a* and its mated socket connector are described in detail with reference to FIG. 7*a*.

In some cases this edge connector 502*a* saves additional space on the horizontal blade 202. As the edge connector 502*a* for the vertical blade 311 is inserted into the connector 502*b* on the horizontal blade 202, the edge connector 502*a* for vertical blade 311 does not need to interface with the connector for the horizontal blade 202 on the surface of the horizontal blade 202. For example, in the system 400 in FIG. 4, the interface section 430 and the socket connector 402*a*, as well as the protruding element 434 may all take up space on the horizontal blade 202. In contrast, only the socket connector 502*b* takes up space on the horizontal blade 202 when an edge connector 502*a* is used.

As the edge connector is slid into the slot of socket connector 502*b*, in some embodiments socket 502*b* includes a circuit protection mechanism that does not electrically couple the contacts within the socket connector 502*b* to the corresponding circuits on horizontal blade 202 until the edge connector 502*a* is fully inserted into the slot in socket connector 502*b*. An embodiment of this mechanism is further described with reference to FIG. 7*a*.

In some cases, having a socket connector 502*b* on the horizontal blade 202 may prevent the vertical blade 311 from having an additional electrical connector 304*a* on the same surface or side of vertical blade 311 as the edge connector 502*a*. This is because the electrical connector 304*a* may impact the socket connector 502*b* when the vertical blade 311 is inserted into the slot 206. Thus, in some embodiments, the electrical connector 304*a* is placed on the obverse side of the vertical blade 311 in relation to the surface on which the edge connector 502*a* is placed. In some alternative embodiments, to avoid this issue, the edge connector 502*a* is lengthened in its transverse dimension so that it may still slide into a slot in socket connector 502*b* but also allow socket connector 502*b* to be far enough from the edge of the slot 206 so that the electrical connector 304*a* can be placed on the same side as the edge connector 502*a* without impacting the socket connector 502*b*.

In some embodiments, the edge connector 502*a* is made of a rigid material and is attached to vertical blade 311 rigidly such that vertical blade 311 may be largely supported structurally by the edge connector 502*a* inserted into socket connector 502*b* alone. This may also require socket connector 502*b* to be rigidly constructed and attached to horizontal blade 202. In some cases, although edge connector 502*a* and socket connector 502*b* do not provide the major structural support for vertical blade 311, the more solid construction of an edge connector 502*a* may allow the edge connector 502*a* to provide a portion of the structural support for vertical blade 311 in contrast to an electrical connector such as electrical connector 304*b* or L-shaped connector 402*b*, both of which may use less rigid physical connections such as electrical pins.

In some cases, the protruding section 520 is not of the same relative proportions compared to the interface section 522 in socket connector 502*b*. The protruding section 520 may be present in order to allocate an area on the horizontal blade to facilitate the connection of all the electrical contacts within the slot in interface section 522 with their respective solder points or other connection points with circuitry on vertical blade 311. This may be done using a variety of methods (e.g., solder joints, contact pads, wire-bonding). The choice of connection method may then determine the size and dimensions of the protruding section 520. In some embodiments, the socket connector 502*b* does not include a protruding section 520, as all the connections between the interface section 522 and the horizontal blade 402 are included within the interface section 522.

In some embodiments, the vertical blade and the horizontal blade are connected via a combination of an edge connector (e.g., connector 502*a*) and an L-shaped connector (e.g., 402*b*). In these embodiments, the edge connector may run along the longitudinal length of the L-shaped connector (e.g., coupled to the protruding element 434 and facing the horizontal blade 202).

Figure 6A:
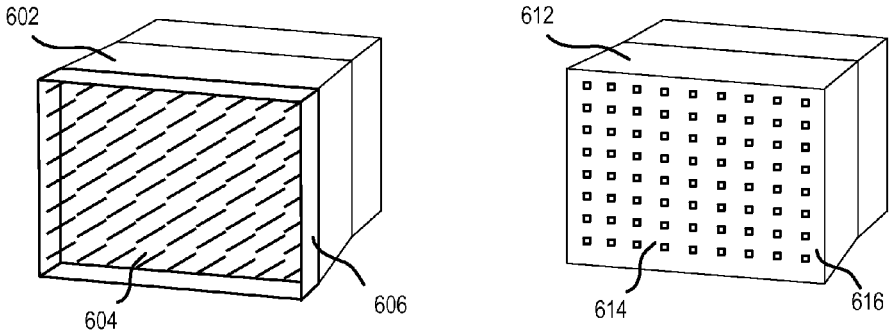
FIG. 6*a* illustrates an exemplary plug and socket for electrical connector 304*b* and 304*a;*

FIG. 6*a* illustrates an exemplary plug and socket for electrical connector 304*b* and 304*a*. Plug 602 inserts into mated socket 612. Electrical connector 304*a* may include either plug 602 or socket 612, and electrical connector 304*b* includes the corresponding mated connection. For example, if electrical connector 304*a* includes plug 602, then electrical connector 304*b* would include socket 612.

Plug 602 includes an interface section 606. In some embodiments interface section 606 is surrounded by a sheath, such as the sheath depicted in the plug 602 for FIG. 6*a*. This sheath encloses the socket 612 when the plug 602 is inserted into the socket 612. Plug 602 also includes electrical pins 604. Although in the depicted embodiment plug 602 includes 72 pins, in other embodiments, the number of pins are different. In some embodiments, the size of the plug 602 and the socket 612 are not the same. These electrical pins are coupled through the body of plug 602 to other circuitry and components in the (vertical or horizontal) blade that the plug is coupled or attached to. These pins may comprise differential pairs (i.e., complementary signals sent on two pairs of wires/pins), and may include a ground connection, a clock signal connection, data signal connections, or other connections that may be used in a circuit design.

Although the depicted plug uses electrical pins 604 as the physical interface medium, in other embodiments the plug 602 may use another physical interface medium (e.g., a flat pin, a trace).

The electrical pins 604 are mated to the socket contacts 614 in socket 612. These socket contacts 614 may be recessed holes with dimensions designed to accept the electrical pins 604. In some embodiments, the interface area 616 of socket 612 fits into the sheath at the interface area 606 of plug 602. This may allow for a more secure connection between plug 602 and socket 612.

Figure 6B:
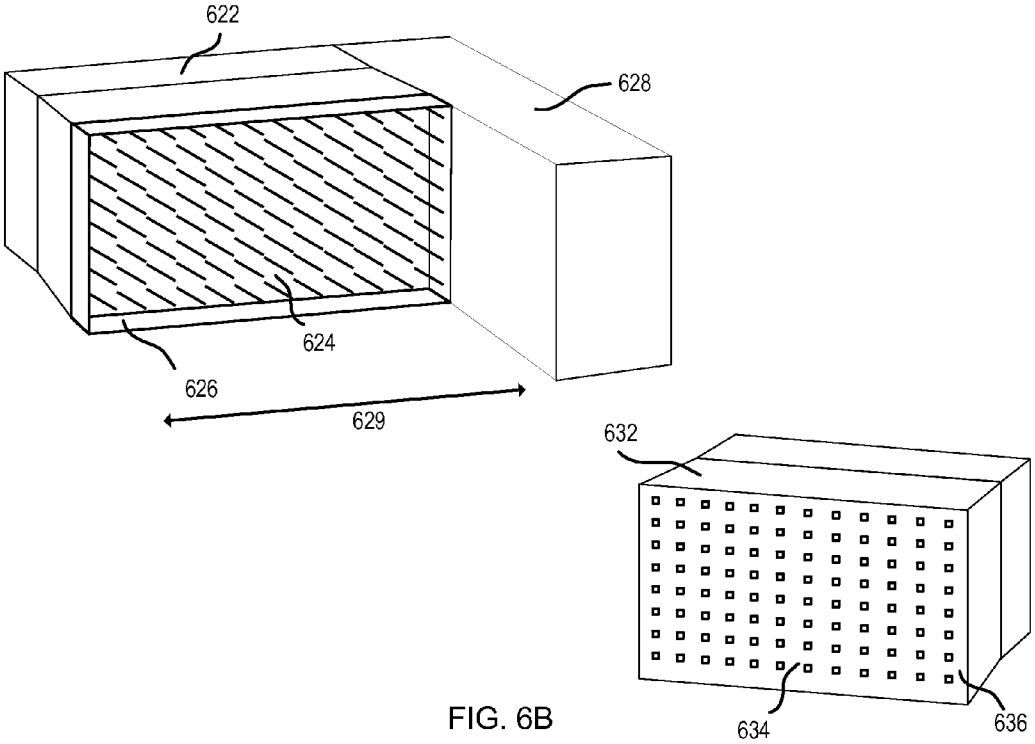
FIG. 6*b* illustrates an exemplary plug 622 for L-shaped connector 402*b* and an exemplary socket 632 for socket connector 402*a;*

FIG. 6*b* illustrates an exemplary plug 622 for L-shaped connector 402*b* and an exemplary socket 632 for socket connector 402*a*. Plug 622 inserts into mated socket 632. Plug 622 comprises electrical pins 624, an interface area 626 with sheath, and a protruding element 628. Protruding element 628 corresponds to the protruding element 434 on L-shaped connector 402*b*. Although the exemplary plug 622 is depicted as having pins, and the exemplary socket 632 is depicted as having holes/contacts, in some embodiments the exemplary plug 622 includes the holes (i.e. it is a "female" connector) and the exemplary socket 632 includes the pins (e.g., it is a "male" connector).

As noted with reference to FIG. 4, L-shaped connector 402*b* includes an interface area that may be extended beyond the width of a typical interface area for an electrical connector for orthogonal connections. As depicted in FIG. 6*b*, plug 622 includes an interface area 626 that has a greater width 629 than that of plug 602. In some embodiments, this width may be of any width so long as the horizontal blade that the socket 632 is coupled to (e.g., blade 202) is wide enough to interface with the connector. Having a wider interface area 626 allows more data to be sent from the vertical blade that the plug 622 is coupled to (e.g., blade 311) to the horizontal blade over a given period of time. The larger interface area includes more pins 624. These additional pins may enable additional connection features, such as a cyclic redundancy check (CRC), checksum, or parity signal to ensure that the data transferred between the two blades has not been corrupted.

In some embodiments, the interface area 626 includes, in addition to the sheath surrounding the interface area 626, additional physical latches, mechanical guides, locking mechanisms, or other mechanisms to further secure the plug 622 to the socket 632. For example, the plug 622 may include a spring-loaded clip on the outside surface of the plug that interfaces with a clip socket on the corresponding side of the socket 632 such that the clip locks the plug and socket into place when the two are connected, and a force is needed to be applied on the locked clip socket to uncouple the plug and socket from each other.

Socket 632 includes socket contacts 634 that correspond to the electrical pins 624 on plug 622. These contacts may be holes in the interface area 636 of socket 632 that are designed to be mated to the electrical pins 624 in plug 622. In some embodiments, the number of socket contacts 634 is equal to the number of electrical pins 624 in the plug 622. In some embodiments, the number of contacts 634 and the number of pins 624 are not equal in number. In some embodiments, socket 632 is not the same size as plug 622.

Figure 7A:
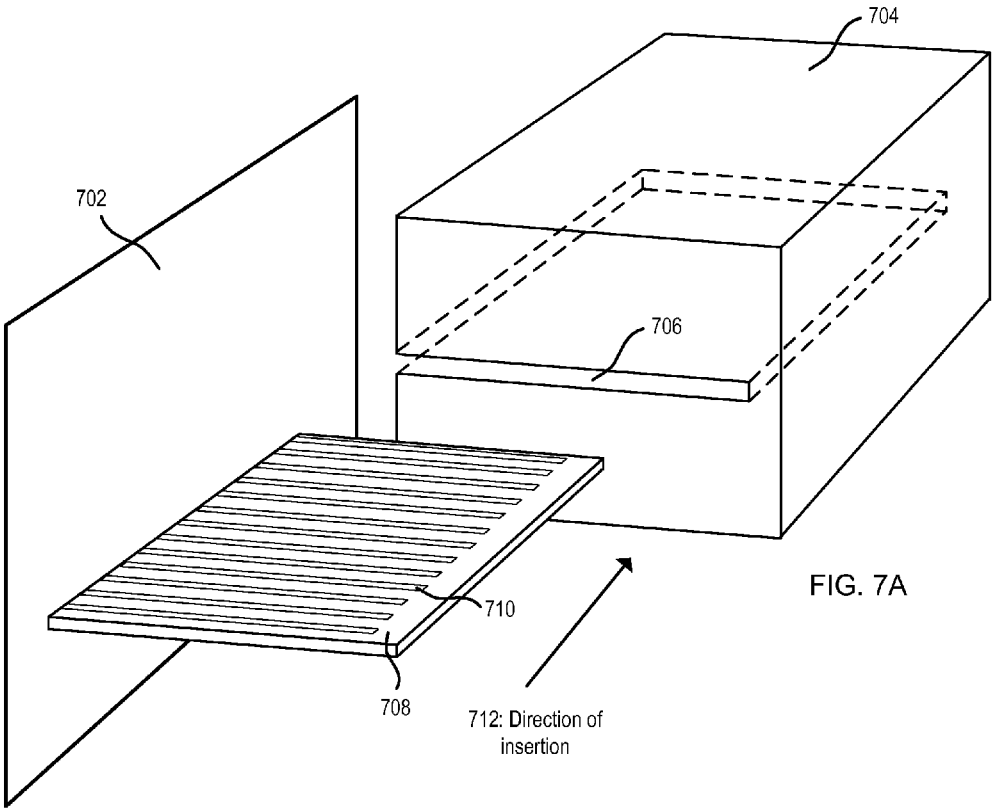
FIG. 7*a* illustrates an exemplary edge connector 708 and an exemplary socket connector 704.

FIG. 7*a* illustrates an exemplary edge connector 708 and an exemplary socket connector 704. In some embodiments, edge connector 708 is edge connector 502*a* and socket connector 704 is socket connector 502*b*.

Edge connector 708 includes traces 710 which are coupled with a vertical blade (e.g., vertical blade 311). The vertical blade is represented by blade section 702. The blade section 702 is not meant to represent the entire vertical blade, but is only meant to denote where the vertical blade would be placed in relation to the edge connector 708. Edge connector 708 includes traces 710 that are coupled with various circuits in the vertical blade. The traces 710 may include a ground connection, clock connection, data connection, etc. The edge connector 708 may also include traces on the obverse side of the side that includes traces 710 (the obverse side is not visible). The drawing in FIG. 7*a* is not drawn to scale, and thus the dimensions of edge connector 708 may not be represented to scale. Edge connector 708 may also include additional traces 710 or fewer trances 710 than the number of traces 710 depicted in FIG. 7*a*.

Edge connector 708 is inserted into slot 706 of socket connector 704 in the direction of insertion 712. Socket connector 704 is coupled to a horizontal blade (e.g., horizontal blade 202) at the bottom surface of socket connector 704. Hence, the open side of the slot 706 faces the hollow slot in the horizontal blade (e.g., hollow slot 206). Slot 706 includes matching traces (not shown) that connect to the traces 710 on edge connector 708 when edge connector 708 is fully inserted into slot 706. These matching traces of slot 706 are coupled with various circuitry in the horizontal blade that the socket connector 704 is coupled to. When edge connector 708 is being inserted into slot 706, one of the traces 710 on edge connector 708 may come in contact with another trace in slot 706 such that an improper connection is made which might damage the circuitry in either the coupled vertical blade or the horizontal blade. In some embodiments, socket connector 704 includes a physical switch mechanism at the far end of slot 706 such that when edge connector 708 is fully inserted into the slot 706, the edge connector 708 engages this switch mechanism, which enables power to the socket connector 704. This ensures that electrical signals flow into the connection only when the connection is fully and properly connected. In some embodiments, when edge connector 708 engages the switch mechanism, a mechanical mechanism exposes the previously concealed traces within slot 706 of socket connector 704 such that they may interface with the traces on edge connector 708. For example, the traces may be lowered or moved into contact with edge connector 708 inside slot 706 when the edge connector 708 engages the switch mechanism. As another example, the traces may be covered with a sheath that retracts when the switch mechanism is engaged.

Figure 7B:
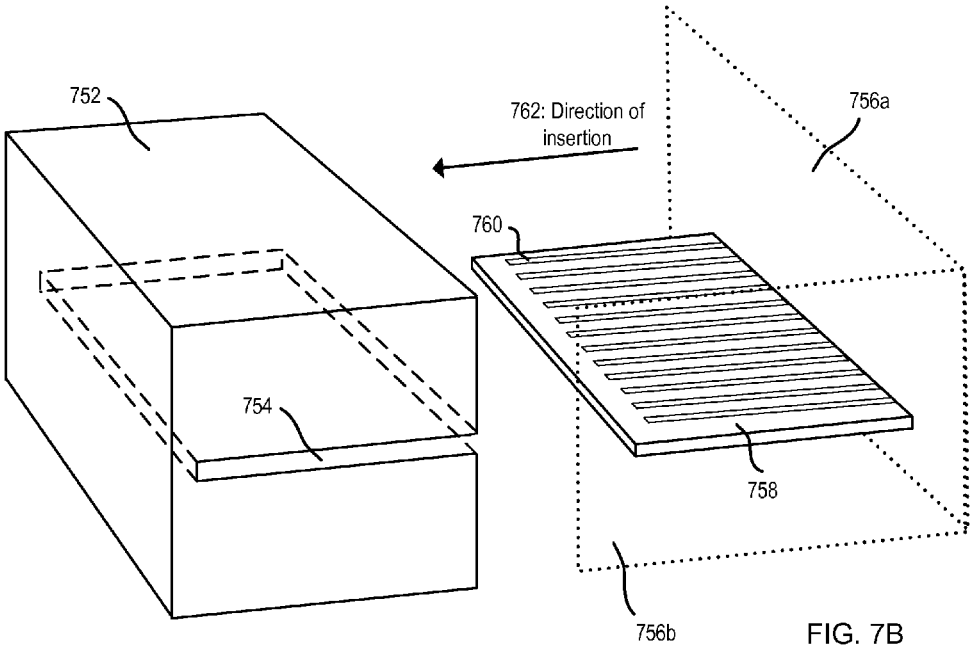
FIG. 7*b* illustrates an exemplary edge connector 758 and an exemplary socket connector 752.

FIG. 7*b* illustrates an exemplary edge connector 758 and an exemplary socket connector 752. In some embodiments, edge connector 758 is the interface 430 for L-shaped connector 402*b* and socket connector 752 is socket connector 402*a*.

Dotted section 756 represents a portion of the L-shaped connector (e.g., 402*b*). Section 756*a* represents a portion of the interface element (e.g., element 430) of the L-shaped connector and section 756*b* represents a protruding element (e.g., element 434) of the L-shaped connector. The edge connector 758 is coupled to the interface element of the L-shaped connector at the location of the interface element. Similar to edge connector 708, edge connector 758 includes traces 760 that are coupled with various circuitry and elements within the vertical blade that is coupled to the L-shaped connector depicted here.

Edge connector 758 is inserted into slot 754 of socket connector 752 in the direction of insertion 762 as indicated. This direction of insertion may be the same as the direction of insertion 310. Slot 754 also includes traces corresponding to the traces 750 on edge connector 758. The traces in slot 754 are coupled to various circuitry within the horizontal blade (e.g., horizontal blade 202) that the socket connector 752 is coupled to. By inserting the edge connector 758 fully into slot 754, a connection can be made between the vertical blade coupled to the edge connector 758 and the horizontal blade coupled to the socket connector 752.

The drawing in FIG. 7*b* may not be drawn to scale, and thus the dimensions of edge connector 758 may not be represented to scale. Edge connector 758 may also include additional or fewer traces than the number of traces 760 depicted in FIG. 7*b*.

Although the above exemplary connectors in FIGS. 7*a* and 7*b* depict an edge connector coupled to the vertical blade and a socket connector coupled to the horizontal blade, in some embodiments of the invention the edge connector is coupled to the horizontal blade and the socket connector is coupled to the vertical blade.

Although the above description along with FIGS. 1-7 reference an electrical connector, in some embodiments, instead of an electrical connector, the invention includes an optical connector. In other embodiments, instead of an electrical connector, the invention includes any type of connector capable of transferring data (e.g., a wireless connector).

Figure 8:
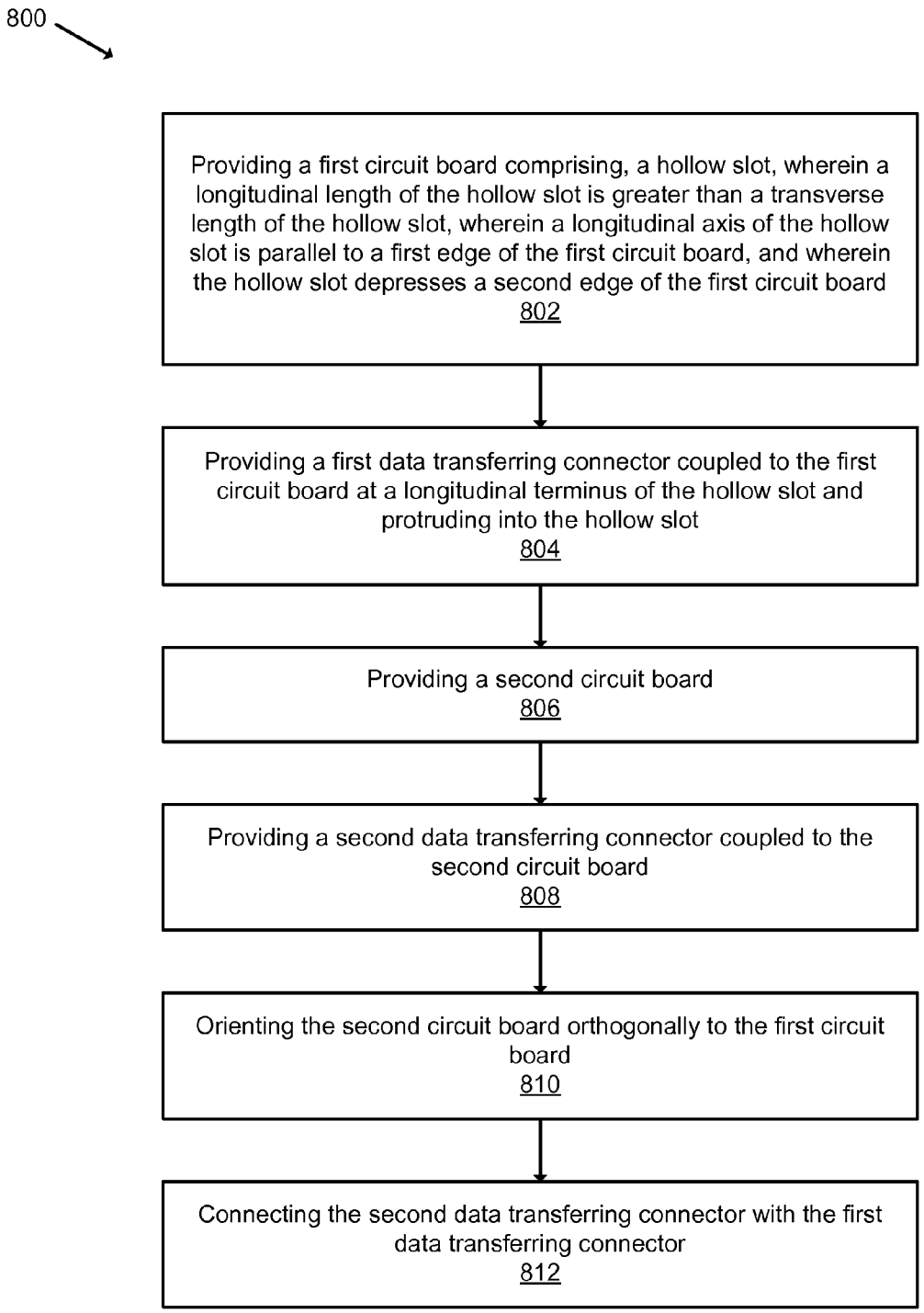
FIG. 8 is a flow diagram illustrating a method of forming a device assembly for reduced chassis depth according to some embodiments of the invention.

FIG. 8 is a flow diagram illustrating a method of forming a device assembly for reduced chassis depth according to some embodiments of the invention. At 802, the method includes providing a first circuit board comprising, a hollow slot, wherein a longitudinal length of the hollow slot is greater than a transverse length of the hollow slot, wherein a longitudinal axis of the hollow slot is parallel to a first edge of the first circuit board, and wherein the hollow slot depresses a second edge of the first circuit board. In some embodiments, the first circuit board is horizontal blade 302. In some embodiments, the hollow slot is slot 206.

At 804, the method includes providing a first data transferring connector coupled to the first circuit board at a longitudinal terminus of the hollow slot. In some embodiments, the first data transferring connector is electrical connector 304*b*. In some embodiments, the first data transferring connector is an orthogonal backplane connector.

At 806, the method includes providing a second circuit board. In some embodiments, this second circuit board is vertical blade 311.

At 808, the method includes providing a second data transferring connector coupled to the second circuit board. In some embodiments, this second electrical connector is electrical connector 304*a*. In some embodiments, the second data transferring connector is an orthogonal backplane connector.

At 810, the method includes orienting the second circuit board orthogonally to the first circuit board. In some embodiments, the second circuit board is vertically oriented and the first circuit board is horizontally oriented.

At 812, the method includes connecting the second data transferring connector with the first data transferring connector.

In some embodiments, connecting the second data transferring connector with the first data transferring connector includes translating the second circuit board along the longitudinal axis of the hollow slot such that the second data transferring connector contacts the first data transferring connector.

In some embodiments, the method further includes providing a third data transferring connector that is adjacent to the hollow slot and is coupled to the circuit board, wherein the third data transferring connector includes a connection interface facing the second edge of the first circuit board, providing a fourth data transferring connector that is coupled to the second circuit board, and connecting the fourth data transferring connector to the third data transferring connector.

In some embodiments, the third data transferring connector is disconnected from the fourth data transferring connector until the fourth data transferring connector is connected to the third data transferring connector at a fully connected position.

Figure 9:
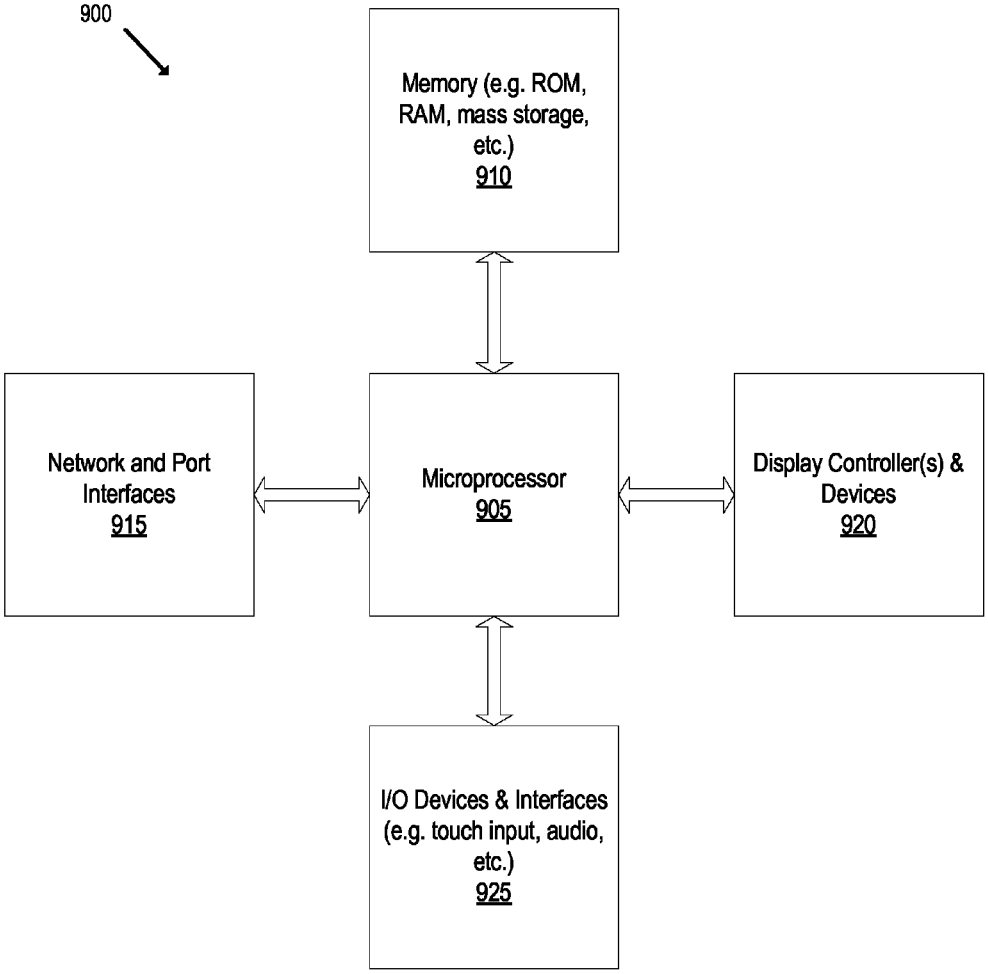
FIG. 9 illustrates, in block diagram form, an example of a processing system 900 according to some embodiments of the invention.

FIG. 9 illustrates, in block diagram form, an example of a processing system 900 such as vertical blade 311 including the functionality of a line card, horizontal blade 202 including the functionality of a control card, a chassis including both vertical and horizontal blades, etc. Data processing system 900 includes one or more microprocessors 905 and connected system components (e.g., multiple connected chips). Alternatively, data processing system 900 is a system on a chip.

Data processing system 900 includes memory 910, which is coupled to microprocessor(s) 905. Memory 910 may be used for storing data, metadata, and programs for execution by the microprocessor(s) 905. For example, memory 910 may include one or more of the data stores 910 and/or may store modules described herein. Memory 910 may include one or more of volatile and non-volatile memories, such as Random Access Memory ("RAM"), Read Only Memory ("ROM"), a solid state disk ("SSD"), Flash, Phase Change Memory ("PCM"), or other types of data storage. Memory 910 may be internal or distributed memory.

Data processing system 900 includes network and port interfaces 915, such as a port, connector for a dock, or a connector for a USB interface, FireWire, Thunderbolt, Ethernet, Fibre Channel, etc. to connect the system 900 with another device, external component, or a network. Exemplary network and port interfaces 915 also include wireless transceivers, such as an IEEE 802.11 transceiver, an infrared transceiver, a Bluetooth transceiver, a wireless cellular telephony transceiver (e.g., 2G, 3G, 4G, etc.), or another wireless protocol to connect data processing system 900 with another device, external component, or a network and receive stored instructions, data, tokens, etc.

Data processing system 900 also includes display controller and display device 920 and one or more input or output ("I/O") devices and interfaces 925. Display controller and display device 920 provides a visual user interface for the user. I/O devices 925 allow a user to provide input to, receive output from, and otherwise transfer data to and from the system. I/O devices 925 may include a mouse, keypad or a keyboard, a touch panel or a multi-touch input panel, camera, optical scanner, audio input/output (e.g., microphone and/or a speaker), other known I/O devices or a combination of such I/O devices.

It will be appreciated that one or more buses, may be used to interconnect the various components shown in FIG. 9.

Data processing system 900 is an exemplary representation of one or more of the devices described above. Data processing system 900 may be a personal computer, tablet-style device, a personal digital assistant (PDA), a cellular telephone with PDA-like functionality, a Wi-Fi based telephone, a handheld computer which includes a cellular telephone, a media player, an entertainment system, or devices which combine aspects or functions of these devices, such as a media player combined with a PDA and a cellular telephone in one device. In other embodiments, data processing system 900 may be a network computer, server, or an embedded processing device within another device or consumer electronic product. As used herein, the terms computer, device, system, processing system, processing device, and "apparatus comprising a processing device" may be used interchangeably with data processing system 900 and include the above-listed exemplary embodiments.

Additional components, not shown, may also be part of data processing system 900, and, in certain embodiments, fewer components than that shown in FIG. 9 may also be used in data processing system 900. It will be apparent from this description that aspects of the inventions may be embodied, at least in part, in software. That is, the computer-implemented method(s) may be carried out in a computer system or other data processing system 900 in response to its processor or processing system 905 executing sequences of instructions contained in a memory, such as memory 910 or other non-transitory machine-readable storage medium. The software may further be transmitted or received over a network (not shown) via network interface device 915. In various embodiments, hardwired circuitry may be used in combination with the software instructions to implement the present embodiments. Thus, the techniques are not limited to any specific combination of hardware circuitry and software, or to any particular source for the instructions executed by data processing system 900.

The processes or methods depicted in the preceding figures may be performed by processing logic that comprises hardware (e.g. circuitry, dedicated logic, etc.), software (e.g., embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

While the figures show a particular order of operations performed by certain embodiments of the invention, it should be understood that such order is exemplary (e.g., alternative embodiments may perform the operations in a different order, combine certain operations, overlap certain operations, etc.).

While the invention has been described in terms of several embodiments, those skilled in the art will recognize that the invention is not limited to the embodiments described, can be practiced with modification and alteration within the spirit and scope of the appended claims. The description is thus to be regarded as illustrative instead of limiting.

What is claimed is:

1. A device, comprising:

a first circuit board having a hollow slot, wherein a longitudinal length of the hollow slot is greater than a transverse length of the hollow slot, wherein a longitudinal axis of the hollow slot is parallel to a first edge of the first circuit board, wherein the hollow slot causes a gap at a second edge of the first circuit board, and wherein the hollow slot is adapted to accept a second circuit board that is oriented orthogonally to the first circuit board; and a first data transferring connector coupled to the first circuit board at a longitudinal terminus of the hollow slot, wherein the first data transferring connector is adapted to connect to a second data transferring connector that is coupled to the second circuit board.

2. The device of claim 1, wherein the first data transferring connector and the second data transferring connector are at least one of an electrical connector, a wireless connector, and an optical connector.

3. The device of claim 1, wherein the first data transferring connector is an orthogonal backplane connector.

4. The device of claim 1, further comprising a third data transferring connector that is adjacent to the hollow slot and is coupled to the first circuit board and that has a connection interface facing the second edge of the first circuit board, wherein the third data transferring connector is adapted to connect to a fourth data transferring connector that is coupled to the second circuit board.

5. The device of claim 4, wherein the third data transferring connector is an orthogonal backplane connector.

6. The device of claim 4, wherein the third data transferring connector is a socket designed to accept an edge connector.

7. The device of claim 1, wherein the first circuit board includes one or more processors and a non-transitory computer readable storage medium including instructions, that when executed by the processor, perform operations of a control plane of a network device.

8. The device of claim 1, further comprising a third data transferring connector coupled to the first circuit board with an interface facing the longitudinal edge of the hollow slot.

9. A device assembly, comprising:

a first circuit board having a hollow slot, wherein a longitudinal length of the hollow slot is greater than a transverse length of the hollow slot, wherein a longitudinal axis of the hollow slot is parallel to a first edge of the first circuit board, and wherein the hollow slot causes a gap at a second edge of the first circuit board;

a first data transferring connector coupled to the first circuit board at a longitudinal terminus of the hollow slot;

a second circuit board oriented orthogonally to the first circuit board and placed within the hollow slot; and a second data transferring connector coupled to the second circuit board and connected to the first data transferring connector.

10. The device assembly of claim 9, wherein the first data transferring connector and the second data transferring connector are at least one of an electrical connector, a wireless connector, and an optical connector.

11. The device assembly of claim 9, wherein the first data transferring connector and the second data transferring connector are orthogonal backplane connectors.

12. The device assembly of claim 9, further comprising a third data transferring connector adjacent to the hollow slot and coupled to the first circuit board, wherein the third data transferring connector includes a connection interface facing the second edge of the first circuit board.

13. The device assembly of claim 12, further comprising a fourth data transferring connector coupled to the second circuit board, wherein the fourth data transferring connector is connected to the third data transferring connector.

14. The device assembly of claim 13, wherein the third data transferring connector is a socket designed to accept an edge connector, and the fourth data transferring connector is an edge connector connected to the third data transferring connector.

15. The device assembly of claim 13, wherein the fourth data transferring connector is a plug including a plurality of electrical pins, and the third data transferring connector is a socket including a plurality of corresponding socket contacts for the plurality of electrical pins, and wherein the third data transferring connector is connected to the fourth data transferring connector.

16. The device assembly of claim 9, wherein the first circuit board includes one or more processors and a non-transitory computer readable storage medium including instructions, that when executed by the processor, perform operations of a control plane of a network device.

17. The device assembly of claim 9, wherein the second circuit board includes one or more processors and a non-transitory computer readable storage medium including instructions, that when executed by the processor, perform operations of a data plane of a network device.

18. The device assembly of claim 9, further comprising a third data transferring connector coupled to the first circuit board with an interface facing the longitudinal edge of the hollow slot, wherein the third data transferring connector is a socket designed to accept an edge connector.

19. The device assembly of claim 9, further comprising a fourth data transferring connector coupled to the second circuit board, wherein the fourth data transferring connector is an edge connector, and wherein the fourth data transferring connector is connected to the third data transferring connector.

20. A method of forming a device assembly, comprising:

providing a first circuit board comprising, a hollow slot, wherein a longitudinal length of the hollow slot is greater than a transverse length of the hollow slot, wherein a longitudinal axis of the hollow slot is parallel to a first edge of the first circuit board, and wherein the hollow slot causes a gap at a second edge of the first circuit board;

providing a first data transferring connector coupled to the first circuit board at a longitudinal terminus of the hollow slot;

providing a second circuit board;

providing a second data transferring connector coupled to the second circuit board;

orienting the second circuit board orthogonally to the first circuit board; and connecting the second data transferring connector with the first data transferring connector.

21. The method of claim 20, wherein the connecting the second data transferring connector with the first data transferring connector includes translating the second circuit board along the longitudinal axis of the hollow slot such that the second data transferring connector contacts the first data transferring connector.

22. The method of claim 20, further comprising:

providing a third data transferring connector that is adjacent to the hollow slot and is coupled to the first circuit board, wherein the third data transferring connector includes a connection interface facing the second edge of the first circuit board;

providing a fourth data transferring connector that is coupled to the second circuit board; and connecting the fourth data transferring connector to the third data transferring connector.

23. The method of claim 22, wherein the third data transferring connector is disconnected from the fourth data transferring connector until the fourth data transferring connector is connected to the third data transferring connector at a fully connected position.

* * * * *